United States Patent [19]

Akashi

[11] 4,265,004

[45] May 5, 1981

[54] SEPARABLE SLIDE FASTENER

[75] Inventor: Shunji Akashi, Kurobe, Japan

[73] Assignee: Yoshida Kogyo K K, Tokyo, Japan

[21] Appl. No.: 36,740

[22] Filed: May 7, 1979

[30] Foreign Application Priority Data

May 19, 1978 [JP] Japan ..... 53/68520[U]

[51] Int. Cl.[3] ..... A44B 19/36

[52] U.S. Cl. ..... 24/205.11 R

[58] Field of Search ..... 24/205.11 R, 205.11 F, 24/205.1

[56] References Cited

U.S. PATENT DOCUMENTS

| | | | |
|---|---|---|---|
| 2,100,557 | 11/1937 | Wintritz | 24/205.11 F |
| 2,814,847 | 12/1957 | Zbinden | 24/205.11 F |
| 3,162,918 | 12/1964 | Burbank | 24/205.11 F |
| 3,872,551 | 3/1975 | Moertel | 24/205.11 F |

FOREIGN PATENT DOCUMENTS

| | | | |
|---|---|---|---|
| 23002 | 6/1935 | Australia | 24/205.11 F |
| 1278775 | 9/1968 | Fed. Rep. of Germany | 24/205.11 F |
| 1339055 | 8/1963 | France | 24/205.11 F |
| 500289 | 2/1939 | United Kingdom | 24/205.11 F |

*Primary Examiner*—Roy D. Frazier
*Assistant Examiner*—Peter A. Aschenbrenner
*Attorney, Agent, or Firm*—Bucknam and Archer

[57] ABSTRACT

A separable slide fastener is disclosed which is provided with a separable end stop assembly comprising a pin member on one stringer and a socket member on the other stringer, both members being releasably interengageable to couple the stringer. Each stringer has a portion of its fabric tape raised above the general plane of the tape and anchored within the stop assembly. The pin part of the assembly is reinforced by a sleeve which has a thickened portion extending closely along a longitudinal marginal edge of the pin.

2 Claims, 6 Drawing Figures

SEPARABLE SLIDE FASTENER

BACKGROUND OF THE INVENTION

1. Field of the Invention

This invention relates to a slide fastener and more particularly to a separable type of slide fastener having a separable end stop assembly.

2. Prior Art

There are known a number of separable slide fasteners equipped with a separator assembly which comprises a socket member mounted on one of two companion stringers and a pin member mounted on the other stringer, the pin and socket members being releasably interengageable to couple the two stringers. When thus coupling the stringers, a slider functioning to close and open the fastener is brought against the socket member, and then the pin member is inserted through a channel in the slider into the socket member. The slider is thereafter moved along the confronting edges of the stringers to progressively take the fastener into closed disposition. Difficulty has been experienced in such instance with the prior art devices in maintaining the stop assembly in good shape against damage over extended periods of use, such difficulty being encountered particularly with the pin member which is susceptible to wear and rupture at and along its longitudinal edge merging with an integral sleeve portion.

SUMMARY OF THE INVENTION

It is therefore an object of the present invention to provide an improved separable slide fastener which will eliminate the above-noted difficulties of the prior art devices.

A more specific object of the invention is to provide a separable slide fastener having means of reinforcing a pin member such that this member can withstand severe external stresses during repeated manipulation thereof in coupling and uncoupling the fastener stringers.

Briefly stated, a separable slide fastener according to the invention is provided with a separable end stop assembly which comprises a pin member on one stringer and a socket member on the other stringer, said socket member having an opening dimensioned to collaterally receive said pin member, said pin member having a sleeve integrally formed therewith and tilted such that the sleeve has a thick region extending longitudinally and adjacent said pin member and a thin region disposed remote from said pin member, and each of said stringer having a portion of its tape cut-away and raised above the general plane of the tape and anchored within said separable end stop assembly.

These and other objects and features of the invention will be better understood by referring to the following detailed description taken in connection with the accompanying drawings which illustrate by way of example a preferred embodiment of the invention.

DETAILED DESCRIPTION OF THE PREFERRED EMBODIMENT

Figure 1:
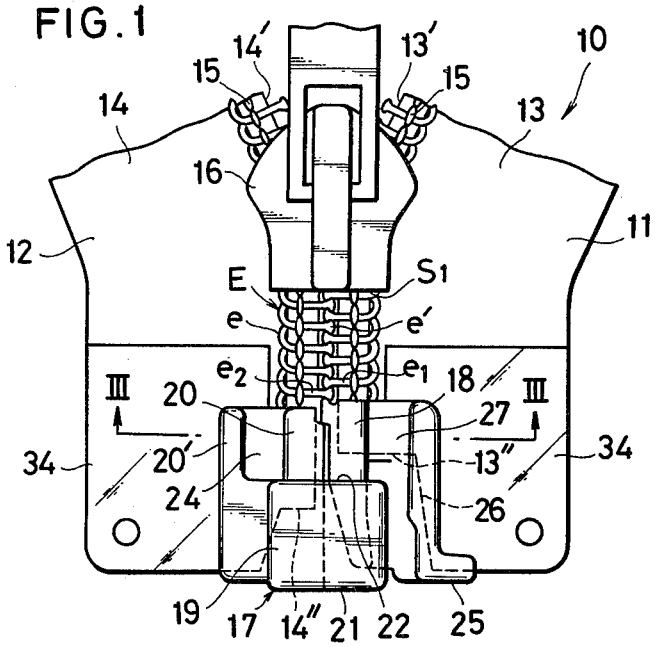
FIG. 1 is a fragmentary plan view of a separable slide fastener provided in accordance with the invention.

Referring now to the drawings and FIG. 1 in particular, there is shown a separable slide fastener 10 which comprises a pair of companion stringers 11,12 having oppositely disposed fabric tapes 13,14 and rows of interlocking fastener elements E mounted on the confronting longitudinal beaded edges 13',14' of the respective tapes 13,14. The fastener elements E are shown for purposes of illustration to be in the form of a continuous helical coil having a succession of convolutions e each with a coupling head portion e' and are sewn as at 15 to the edge of the respective tape. The two companion stringers 11,12 are taken into and out of meshing or interlocking engagement with each other by the manipulation of a slider 16 in the well known manner.

The stringers 11 and 12 are held together at their one ends by means of a separable end stop assembly generally designated 17 which is disposed to envelop cut-away portions 13'',14'' of the tapes. The stop assembly 17 is shown for purposes of illustration as applied to the lower ends of the stringers 11,12, and hence serves as a bottom end stop.

The separable end stop assembly 17 comprises a pin member 18 mounted on one stringer 11 and a socket member 19 mounted on the other stringer 12, the pin and socket members being releasably interengageable to couple the companion stringers 11,12, in the well known manner.

Figure 2:
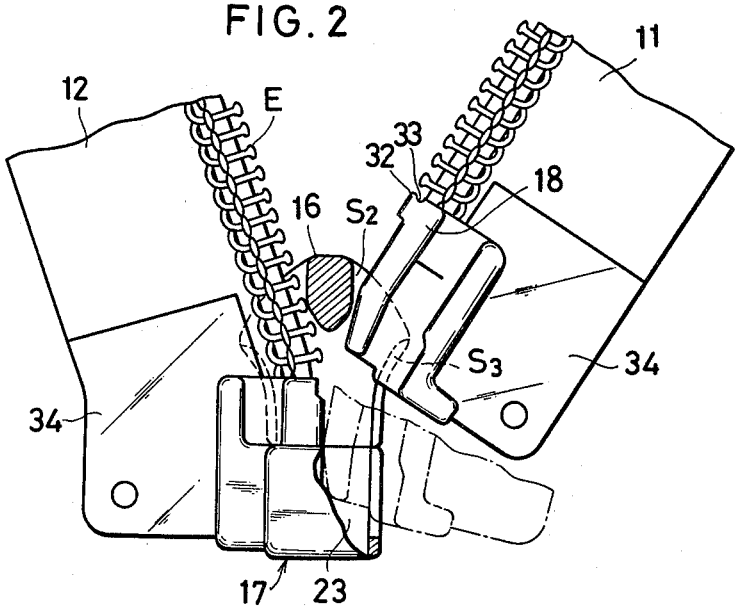
FIG. 2 is a fragmentary plan view of the separable slide fastener utilized to explain the manner of coupling or uncoupling the two companion stringer.

The socket member 19 has a stud portion 20 extending from below the terminal end convolution $e_2$ of interlocking element row E to the region of the lower edge of its companion stringer 12. Formed integrally with the stud portion 20 is a socket portion 21 having an abutment 22 extending transversely beyond the beaded edge 14' of stringer 12 and coextensive with the rear end $S_1$ of the slider 16 such that the latter may be borne against the abutment 22 in the assembled relation of the pin and socket members 18,19 when inserting the pin 18 into the socket 19 as shown in FIG. 2. The socket portion 21 is provided with an opening 23 dimensioned to collaterally receive the pin member 18. Disposed oppositely to and parallel with the stud portion 20 is a similar stud portion 20', the two stud portions 20,20' being interconnected by a sleeve 24.

The pin member 18 extends longitudinally along its companion beaded edge 13' from below the end convolution $e_1$ to the region of the lower edge of its companion stringer 11. Disposed oppositely to and parallel with the pin member 18 is an L-shaped gripping portion 25 which is disposed to envelop a marginal edge 26 of the cut-away tape portion 13'' and which serves to allow finger-gripping when inserting the pin 18 into the socket 19. The pin 18 and the gripping portion 25 are interconnected by a reinforced sleeve 27. The reinforced sleeve 27 is tilted downwardly toward the gripping portion 25 so that it has a thick region **27*a* adjacent the pin 18 and a thin region 27*b* remote from the pin 18 or adjacent the gripping portion 25**.

The pin member 18 has a bump 32 projecting transversely slightly beyond the beaded edge 13', the bump 32 having a recess 33 dimensioned to receive the coupling head e' of the end convolution $e_2$ on stringer 12 in the assembled relation of pin 18 and socket 19.

It will be noted that the separable end stop assembly 17 is preferably made of a plastic material such that all of the various portions discussed of the assembly 17 can be conveniently molded into the respective desired shapes and fused integrally with the fabric of the stringer tapes 13,14. Designated at 34 is a reinforcing strip of film attached to the bottom portion of the respective tape 13,(14) over both surfaces thereof, and over which the separable stop assembly 17 are laid.

Figure 3:
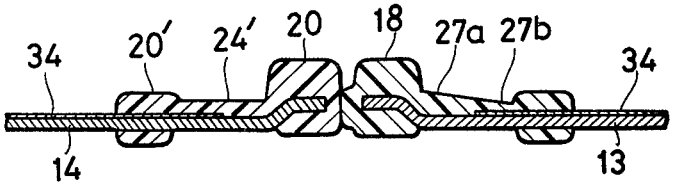
FIG. 3 is an enlarged cross-sectional view taken on the line III—III of FIG. 1.
Figure 4:
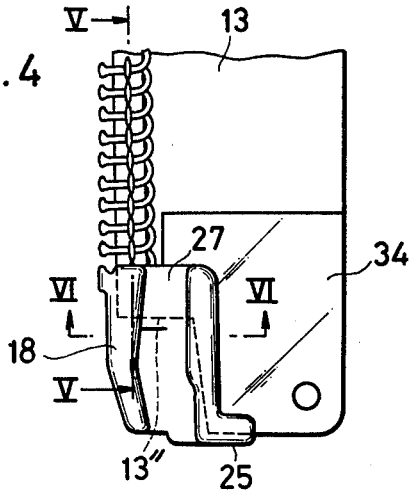
FIG. 4 is a fragmentary plan view of one of the two companion stringers having mounted thereon a preferred form of pin member according to the invention.
Figure 5:
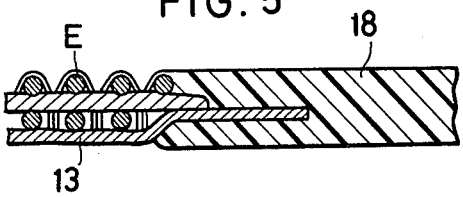
FIG. 5 is an enlarged cross-sectional view taken on the line V—V of FIG. 4.
Figure 6:
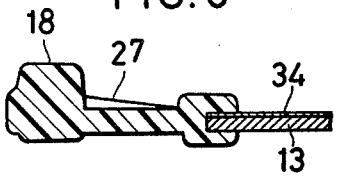
FIG. 6 is an enlarged cross-sectional view taken on the line VI—VI of FIG. 4.

As shown in FIGS. 3 and 5, the cut-away marginal portions 13" and 14" of the respective tapes are partly raised above the general plane of the tape and anchored within the molded separator assembly 17 with the total thickness of the stringers 11,12 (FIG. 5) not exceeding the thickness of the pin 18 and the stud 20 of the separator 17. This arrangement provides for strong bondage of the tape 13,(14) and the separator 17.

With this construction of the separable slide fastener according to the invention, the pin 18 is inserted into a channel $S_2$ of the slider 16, which has been held in abutted relation to the socket member 19, and thence into the opening 23 of the socket member 19. The insertion of the pin 18 is conveniently done by finger-gripping the integral L-shaped reinforcing portion 25. The pin member 18 advances unobstructedly with respect to the slider because the reinforced sleeve 27 is reduced in thickness as at *27b* where it registeres with the region of flanged opening $S_3$ of the slider as shown in FIG. 2. The pin member 18 further advances into the opening 23 of the socket member 19 until it comes into fully assembled engagement with the socket member 19 as shown in FIG. 1, in which the pin member 18 is firmly retained in place with respect to the socket member 19. Because the sleeve 27 is thickened as at *27a*, this marginal portion is reinforced against repeated engaging and disengaging operation of the separator 17.

While the invention has been shown and described in its preferred form, changes may be made in the structure disclosed without departing from the scope of the appended claims.

What is claimed is:

1. A separable slide fastener comprising:

(a) a pair of companion stringers each having a fabric tape and a row of interlocking fastener elements mounted on a longitudinal edge of said tape;

(a) a slider slidably mounted on the rows of fastener elements for taking the same into and out of coupling engagement, said slider having a flanged opening; and (c) a separable end stop assembly comprising:

(1) a pin member mounted on one of said companion stringers;

(2) a socket member mounted on the other stringer and having an opening receptive collaterally of said pin member therein through said slider, each of the tapes having an end portion raised above the general plane of the tape in transverse and longitudinal directions thereof and anchored within one of said pin and socket members; and (3) a reinforcing sleeve portion integrally formed with said pin member and having a slant thick region extending longitudinally along and adjacent to said pin member, and a thin region disposed remotely from said pin member for registration with and through said flanged opening when said pin member is inserted through said slider.

2. A separable slide fastener according to claim 1, including an L-shaped grip portion integral with said sleeve portion and disposed adjacent to said thin region thereof.

* * * * *